US007641154B2

(12) United States Patent
Register

(10) Patent No.: US 7,641,154 B2
(45) Date of Patent: Jan. 5, 2010

(54) DEVICE FOR HOLDING TRASH BAGS OPEN

(76) Inventor: Don Allen Register, 2280 Bear Mountain Dr., NE., Conyers, GA (US) 30013

( * ) Notice: Subject to any disclaimer, the term of this patent is extended or adjusted under 35 U.S.C. 154(b) by 217 days.

(21) Appl. No.: 11/593,460

(22) Filed: Nov. 6, 2006

(65) Prior Publication Data

US 2007/0257163 A1 Nov. 8, 2007

Related U.S. Application Data

(60) Provisional application No. 60/733,476, filed on Nov. 5, 2005.

(51) Int. Cl.
*B65B 67/04* (2006.01)

(52) U.S. Cl. ..... 248/99

(58) Field of Classification Search ..... 248/99, 248/100, 101, 51; 224/269; 269/1.1; 383/33; 141/390

See application file for complete search history.

(56) References Cited

U.S. PATENT DOCUMENTS 4,106,734 A * 8/1978 Walitalo ..... 248/100
4,805,858 A * 2/1989 Taylor ..... 248/99
5,217,271 A * 6/1993 Moe ..... 294/1.1
5,588,622 A * 12/1996 Gordon, Sr. ..... 248/101
6,003,717 A * 12/1999 Long ..... 220/495.11
6,478,157 B1 * 11/2002 Witt et al. ..... 206/702
6,604,717 B2 * 8/2003 Stanfield ..... 248/99
7,108,216 B2 * 9/2006 Burke et al. ..... 242/378.1
2006/0118062 A1 * 6/2006 Edwards ..... 119/796
2006/0180621 A1 * 8/2006 Ladouceur ..... 224/269
2007/0086681 A1 * 4/2007 Richardson et al. ..... 383/16

* cited by examiner

*Primary Examiner*—Ramon O Ramirez
(74) *Attorney, Agent, or Firm*—Michael J. Bootcheck, LLC

(57) ABSTRACT

Devices for maintaining the mouth of a bag in an open condition. The device may comprise a housing with a cavity and at least one opening, and at least one support band which is at least partially positioned in the cavity, wherein a first end of the at least one support band is located in the cavity and at least a portion of the at least one support band extends exterior of the housing, and the at least one support band has at least two positions relative to the housing, a retracted condition in which a majority of the at least one support band is positioned in the cavity and an extended condition in which less than a majority of the at least one support band is located exterior to the cavity.

20 Claims, 6 Drawing Sheets

FIG. 1
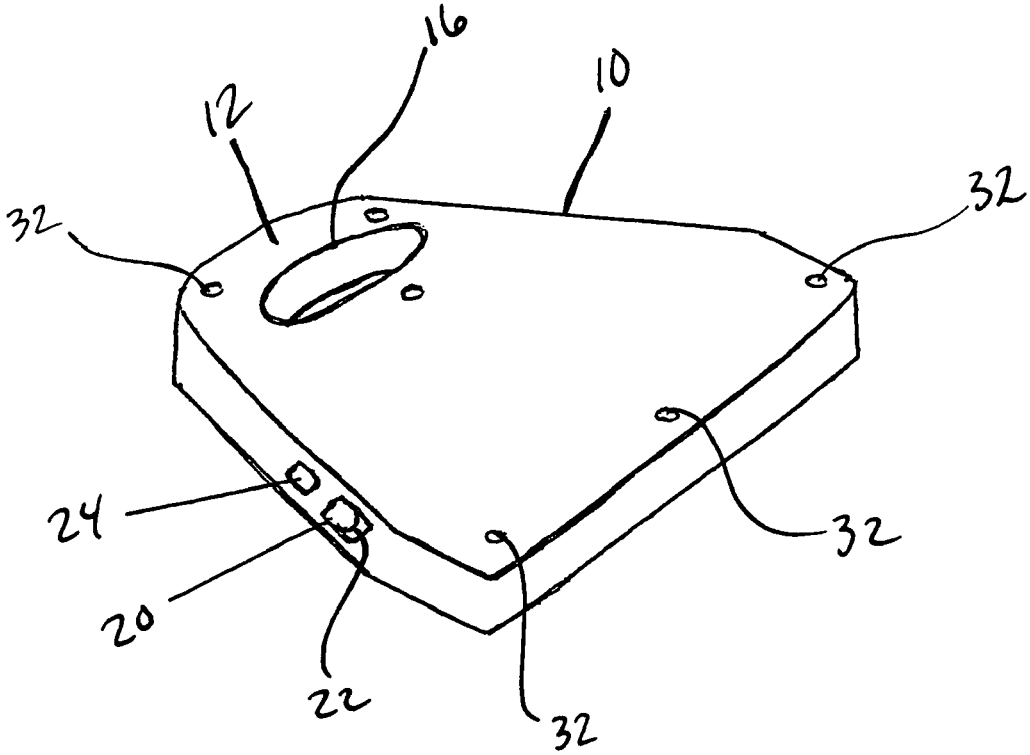
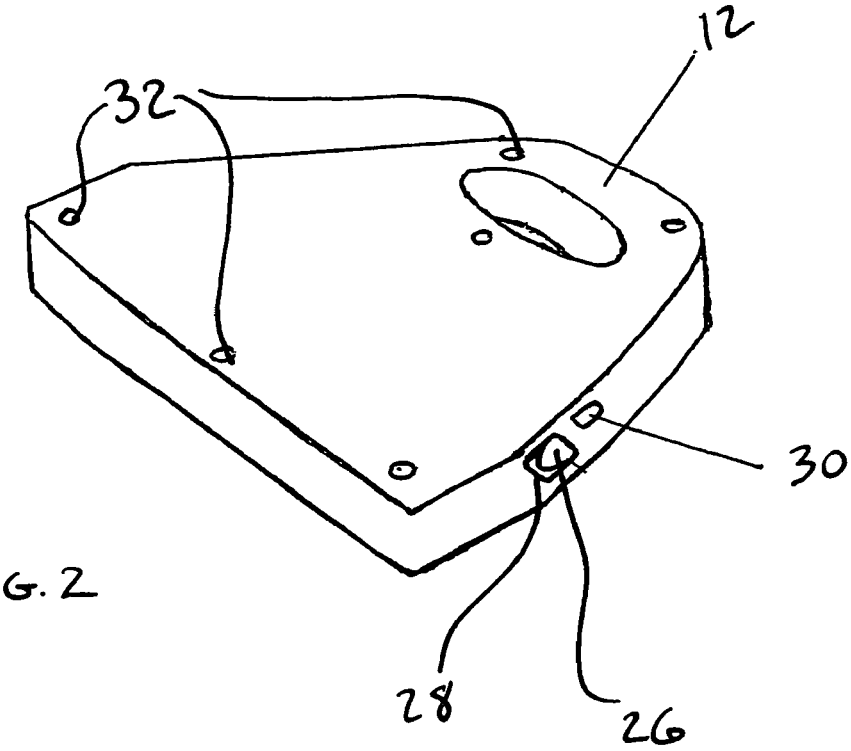
FIG. 2

FIG. 3
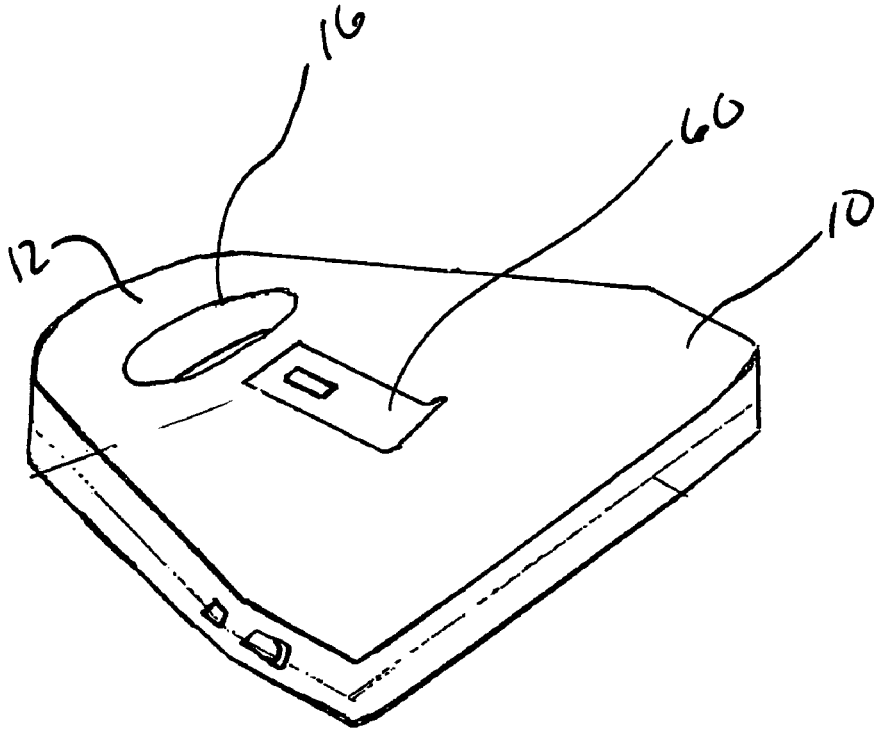
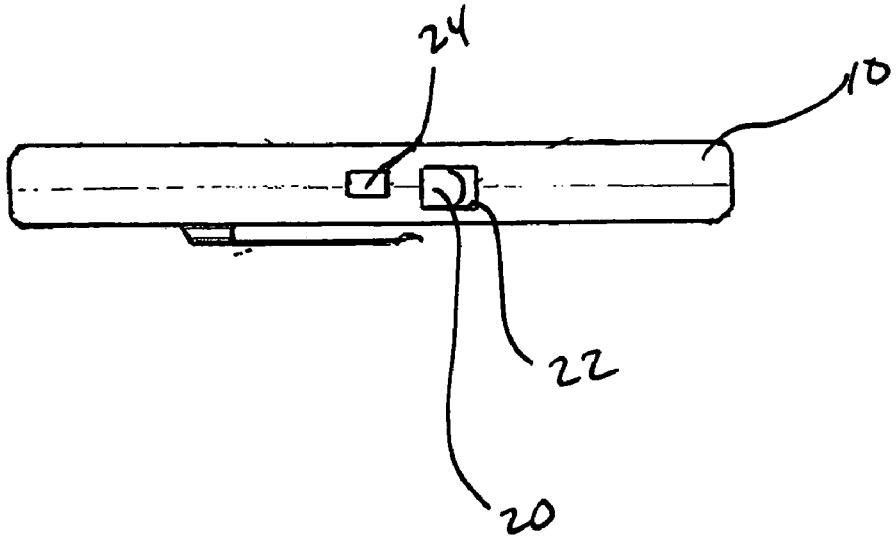
FIG. 4

DEVICE FOR HOLDING TRASH BAGS OPEN

CROSS-REFERENCE TO RELATED APPLICATIONS

This application claims priority from U.S. provisional application Ser. No. 60/733,476, filed Nov. 5, 2005, which is titled "Adjustable Device for Holding Trash Bags Open", and which is hereby incorporated by reference.

FIELD OF THE INVENTION

The present invention relates to devices for maintaining the mouth of a bag in an open condition in order to place debris, laundry, or other materials into such bags. Such bags can include, but are not limited to, disposable plastic bags, reusable nylon bags, and cloth bags.

BACKGROUND OF THE INVENTION

Anyone attempting to bag material or debris, such as leaves or other waste, has experienced the frustration of trying to simultaneously hold the mouth of the bag open and try to place the material into the bag. The bag, particularly disposable plastic bags and lightweight nylon bags, are very floppy and the mouth is, at best, partially open and must be repeatedly re-opened. An alternative is to have one person open the mouth of the bag while another person places the material into the bag. Such a method is inefficient in that it requires two people and, because one person is constantly adjusting the mouth of the bag, at least partially obstructs the mouth of the bag thus inhibiting the loading process.

SUMMARY OF THE INVENTION

The present invention is directed to devices for maintaining the mouth of a bag in an open condition. The devices are adjustable to accommodate bags of various sizes and materials.

According to one exemplary embodiment of the present invention, the device comprises a housing with a cavity and at least one opening, and at least one support band which is at least partially positioned in the cavity. The at least one support band has at least two conditions relative to the housing, a retracted condition in which a majority of the at least one support band is positioned in the cavity and an extended condition in which less than a majority of the at least one support band is located into the cavity.

According to another exemplary embodiment of the present invention, the device comprises a housing, a first support band connected to the housing at a first support band first end, and a second support band connected to the housing at a second support band first end. The length of the first support band external to the housing is variable and the length of the second support band external to the housing is variable. Further, the first support band second is detachably connectible with the second support band second end.

In another exemplary embodiment of the present invention, the device comprises a housing having a cavity internal to the housing, a first spool located in the cavity, a second spool located in the cavity, a first support band attached to the first spool at a first support band first end with a first support band second end located outside the cavity, and a second support band attached to the second spool at a second support band first end with a second support band second end located outside the cavity. The length of the first support band exterior to the cavity is variable by rotating the first spool, and the length of the second support band exterior to the cavity is variable by rotating the second spool.

BRIEF DESCRIPTION OF THE FIGURES

FIG. 1 depicts a perspective view of an exemplary embodiment of the present invention;

FIG. 2 illustrates an alternate view of the exemplary embodiment of FIG. 1;

FIG. 3 illustrates another alternate view of the exemplary embodiment of FIGS. 1-2;

FIG. 4 illustrates a side view of the exemplary embodiment of FIGS. 1-3;

DETAILED DESCRIPTION OF THE INVENTION

Figure 5:
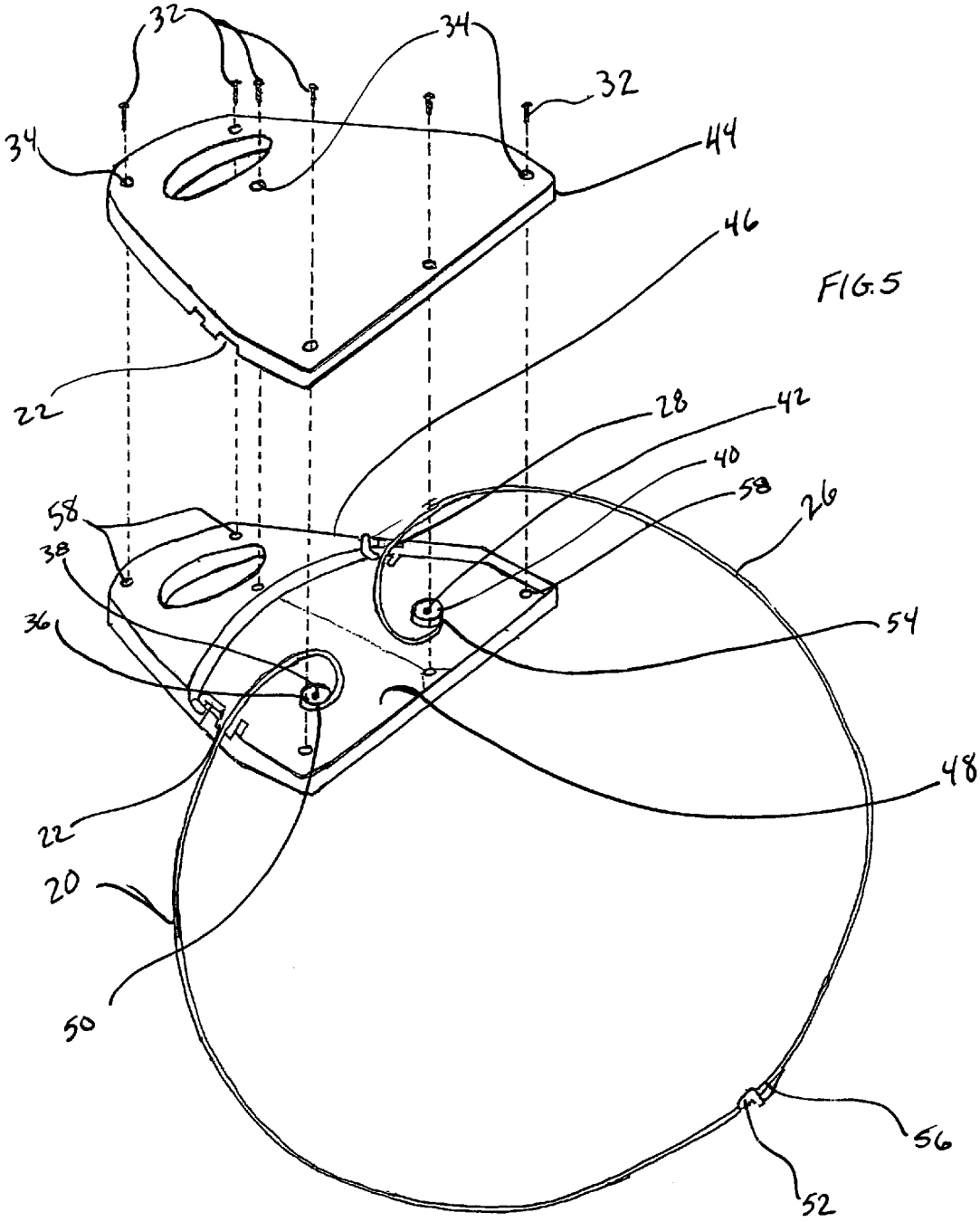
FIG. 5 depicts an exploded view of another exemplary embodiment of the present invention.

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to devices that may have one or more extendable supports which extend from a housing in order to maintain the opening of a bag such that debris and other items or materials may be placed into the bag. The devices of the present invention may be utilized with bags comprised of plastic, fabric, and other materials. Such devices are adjustable in order to be utilized with bags of various dimensions including bags of varying diameter. The supports of such devices may be retracted into a cavity in the housing for convenient storage. One exemplary device of the present invention is shown in FIGS. 1-4. FIG. 1 illustrates an exemplary embodiment of the present invention illustrating housing 10. The embodiment also includes one or more support bands such as first support band 20 which are extendable from housing 10. In this embodiment, first support band 20 may be partially extracted from housing 10 by way of first opening for first band 22. Also illustrated in FIG. 1 is a first band lock 24 which may be placed in at least two conditions, a first condition ("locked") in which first support band 20 is locked with respect to housing 10 and a second condition ("unlocked") in which first support band 20 may be extracted/retracted with respect to housing 10. In practice, when first band lock 24 is unlocked, first support band 20 may be extracted to a desired length (i.e., to support a given sized bag), and then first band lock 24 may be locked. First band lock 24 may be of any suitable mechanism, including, but not limited to, a slide lock, a spring biased lock, a pneumatic lock, a manual slide lock, an elastic lock.

Housing 10 may be of unitary construction or of multiple components and may be comprised of various materials including, but not limited to, plastic, metal, aluminum, steel, ceramic, and wood. In the embodiment illustrated in FIG. 1, housing 10 is comprised of multiple components such that screws 32 may be utilized to secure the various components together. Various means may be utilized to secure the various components together such as, but not limited to, screws, gluing, bonding, bolting, welding, snap fit, zippers, hooks and loops (such as available under the trade name Velcro®), snaps, etc.

FIG. 1 also illustrates an optional slot 16 which may extend partly or entirely through housing 10. Also illustrated is an optional handle 12 which may be utilized for grasping, holding or manipulating the device. The exemplary embodiment illustrated allows a user to grasp housing 10 by either grasping an outer perimeter of handle 12 or allows a user to insert their fingers through slot 16 in order to manipulate the device.

FIG. 2 illustrates another perspective view of the exemplary embodiment of FIG. 1. FIG. 2 shows a second support band 26, which is extendable from housing 10 by way of a second opening for second band 28. Also illustrated is a second band lock 30 which may operate similarly to first band lock 24 discussed above.

FIG. 3 illustrates a perspective view of the underside of the illustrated embodiment of FIGS. 1-2. A belt clip 60 is shown in this view wherein belt clip 60 may be used to attach housing 10 of the device to a user's belt, for example, when the device is not in use. Though illustrated as a belt clip, it is also within the scope of the invention to have a carrying strap, or other means, in contact with the housing in order to permit a user to transport a device in accordance with the present invention.

FIG. 4 illustrates another view of the exemplary embodiment of FIGS. 1-3 illustrating a side view showing an exemplary configuration of belt clip 60 with respect to housing 10. In the embodiment of FIG. 4, first support band 20, first opening for first band 22, first band lock 24 can also be seen.

FIG. 5 illustrates an exploded view of an alternate embodiment of the present invention in which housing 10 is comprised of housing first portion 44 and housing second portion 46. Screws 32 may be utilized connect housing first portion 44 to housing second portion 46 though it is also acceptable to utilize other means as discussed above. In the illustrated embodiment, screws 32 extend through holes 34 in housing first portion 44 into receptors 58 in housing second portion 46.

Figure 7:
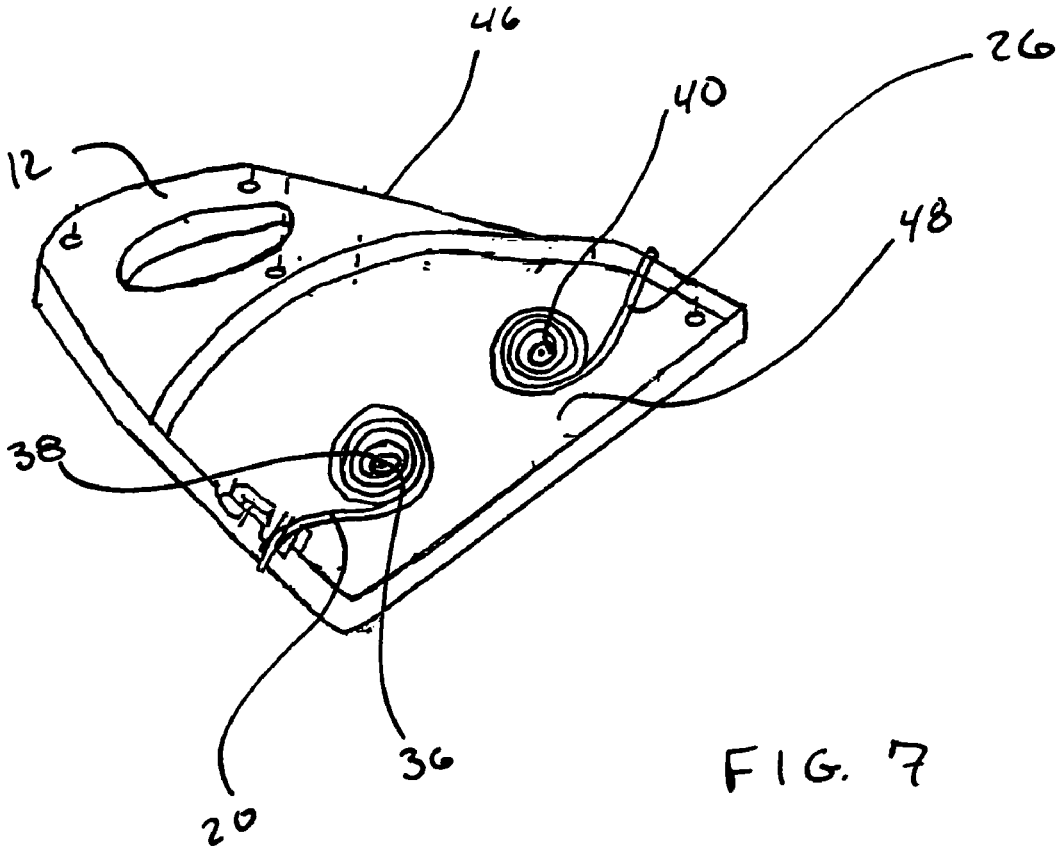
FIG. 7 illustrates another exemplary embodiment of the present invention in a retracted condition.

Also shown in FIG. 5 is an arrangement of first support band 20 and second support band 26. In the illustrated embodiment, first support band 20 has a first band first end 50 and a first band second end 52 whereas second support band 26 has a similar second band first end 54 and a second band second end 56. In this embodiment, first band first end 50 may be attached to a first spindle or spool 36 such that first support band 20 may wrap about spool 36 (FIG. 7 illustrates a similar arrangement in which first support band 20 is wrapped about spool 36). In the illustrated embodiment, spool 36 may pivot about a first spool axis 38. In a similar fashion, second band first end 54 may be attached to a second spool 40 such that it may be wound/unwound from second spool 40 which may pivot about a second spool axis 42.

FIG. 5 also illustrates a configuration in which first band second end 52 is detachably connected to second band second end 56. In the illustrated embodiment, the respective second ends 52, 56 may have any suitable connection means, including, but not limited to, interlocking s-shaped ends, interlocking male-female ends such that one of the second ends may connect to the other second end. Also illustrated in FIG. 5 are first opening for first band 22 and first opening for second band 28 each of which allows their respective support band to be expelled/retracted from housing 10. Support bands 20, 26 may be constructed of any suitable materials including, but not limited to, plastic, rubber, metal, aluminum, and ceramics and may have a cross-sectional shape including, but not limited to, round, elliptical, and rectangular.

Figure 8:
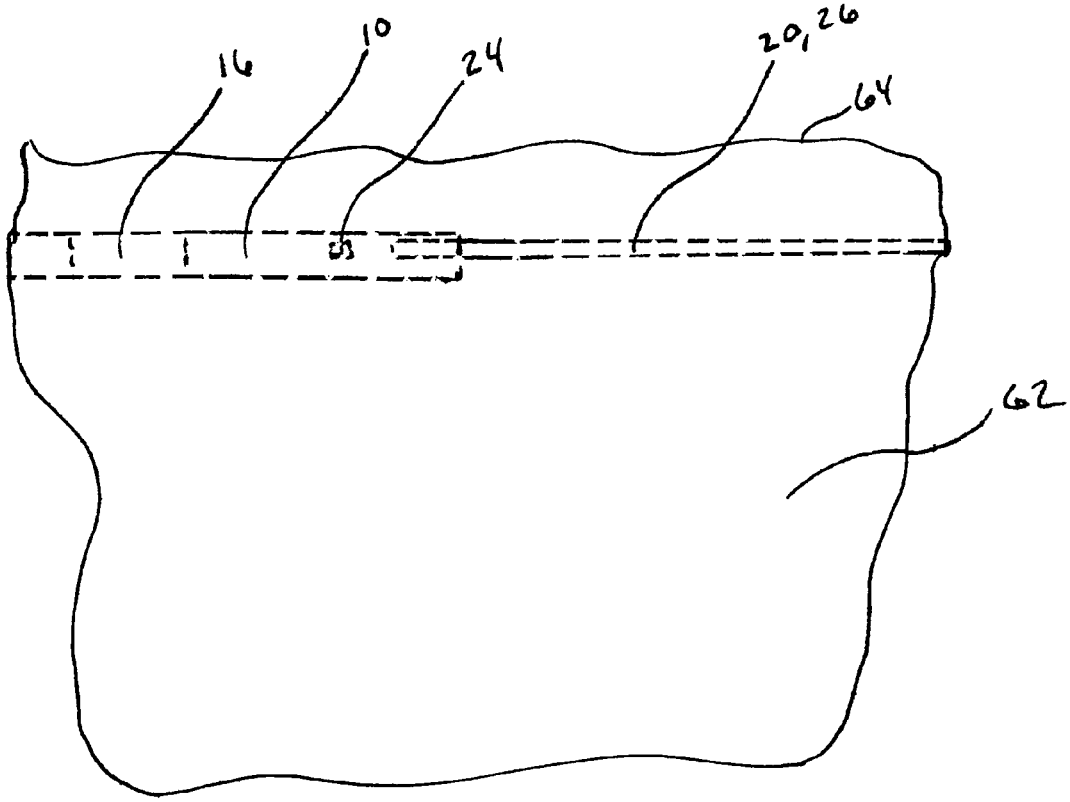
FIG. 8 illustrates an exemplary embodiment of the present invention in combination with a bag.
Figure 9:
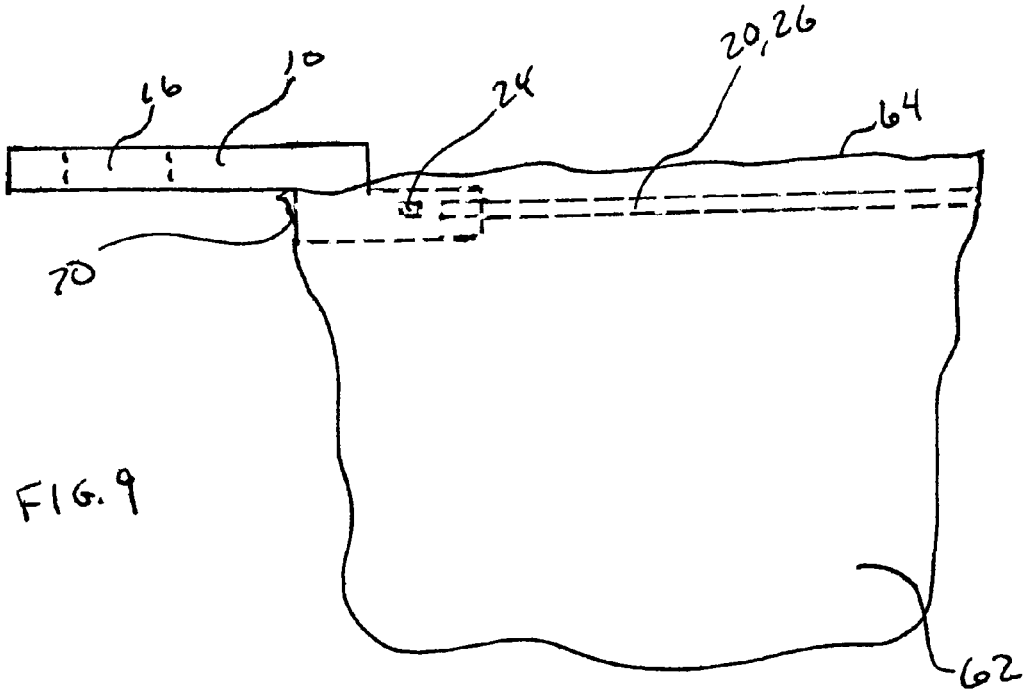
FIG. 9 illustrates another exemplary embodiment of the present invention in combination with a bag.

In some embodiments, spools 36, 40 may be biased in order to cause their respective support bands 20, 26 to be retracted into cavity 48 of housing 10 when their respective band locks 24, 30 are in a condition to allow such movement of support bands 20, 26. In such embodiments, when a user desires to utilize the device, the user can (1) switch first band lock 24, for example, from the locked condition to the unlocked condition, (2) then pull on first band second end 52 with sufficient force to overcome the retraction force of the biased spool until a desired length of first support band 20 has been extracted from housing 10, and (3) then switch first band lock 24 to its locked condition to prevent the support band 20 from being prematurely retracted into housing 10. The user can similarly retract a desired length of second support 26 from housing 10. In use, a user may extract a sufficient length of support bands 20, 26 such that a mouth of a bag is maintained in an open condition as shown in FIGS. 8-9. Once a user is done utilizing the device, the user can move band locks 24, 30 to their respective unlocked conditions, thus allowing support bands to be retracted into housing 10 and freeing the mouth of the bag.

In other embodiments, spools 36, 40 may be free-spinning about their respective spool axis 38, 42. In these embodiments, a user may manually extract and retract support bands 20, 26 from housing 10 while using 24, 30 locks to control the length and configuration of support bands 20, 26 as desired.

In still other embodiments, spools 36, 40 may be biased in order to expel their respective support bands 20, 26 such that when their respective locks 24, 30 allow such movement, support bands 20, 26 are expelled until a desired length of support bands 20, 26 have been expelled at which time the user may switch the respective locks 24, 30 to their locked conditions. In yet other embodiments, the expelling force of the support bands 20, 26 may be sufficient that it is not necessary to switch locks 24, 30 to a locked condition in order to maintain support bands 20, 26 as desired.

Biasing means for spools 36, 40 include, but are not limited to, spring biasing, pneumatic means, electrical biasing, electronic biasing, and hydraulic biasing.

Figure 6:
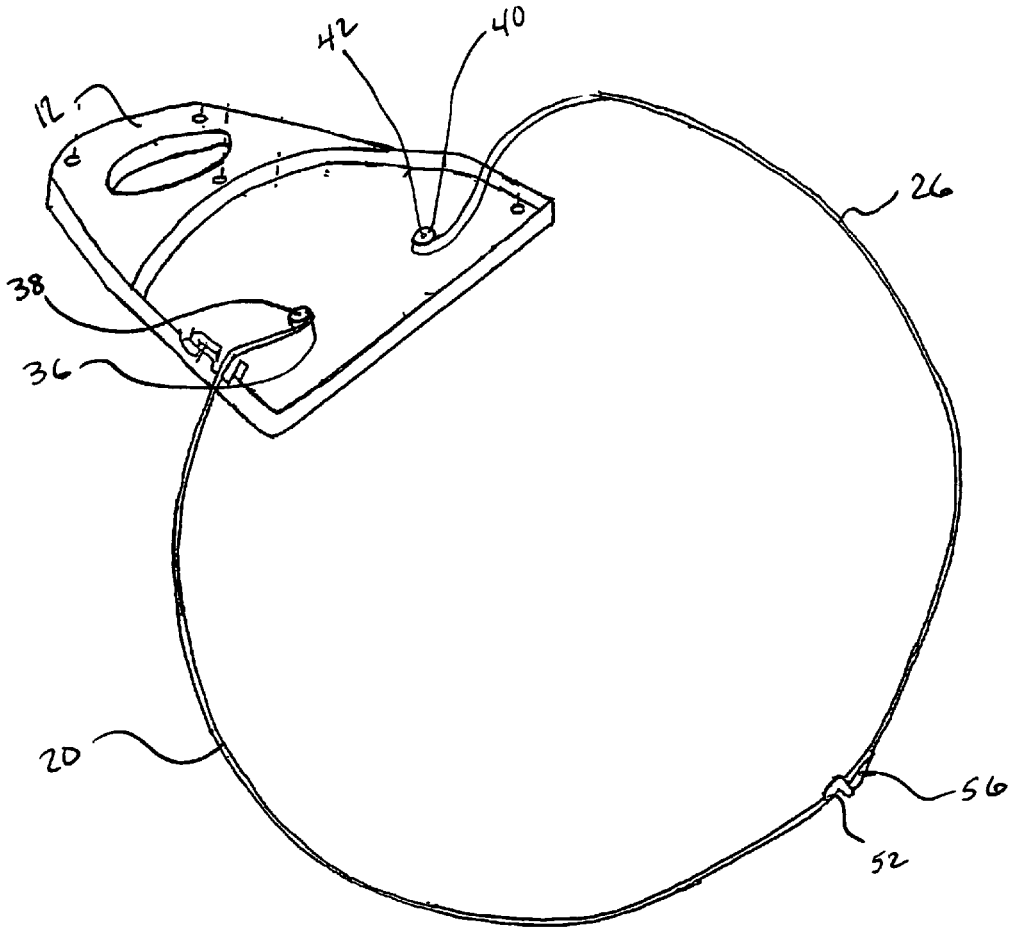
FIG. 6 depicts a partial exploded view of another exemplary embodiment of the present invention.

FIG. 6 illustrates another embodiment of the present invention. In this embodiment, the respective support bands 20, 26 are wound in a counter-direction to that illustrated in the embodiment of FIG. 5 relative to respective spools 36, 40. In some embodiments, it may be advantageous to configure support bands 20, 26 such as that illustrated in FIG. 5 whereas in other embodiments, it may be advantageous to configure support bands 20, 26 as that illustrated in FIG. 6.

FIG. 7 illustrates another configuration of the embodiment illustrated in FIG. 6 in which support bands 20, 26 are in a retracted/wound configuration about their respective spool 36, 40. FIG. 8 illustrates an exemplary embodiment according to the present invention in combination with a bag 62 situated about the device. In the illustrated embodiment and configuration, a mouth 64 of bag 62 is maintained in position by a combination of housing 10 and support bands 20, 26 which exert an outward force on the inside of bag 62. Thus mouth 64 is maintained in an open condition by the tension of housing 10 and support bands 20, 26 on bag 62.

FIG. 9 illustrates another exemplary embodiment according to the present invention in combination with bag 62 situated about the device. In this embodiment, housing 10 is configured with a lowered portion 70 which allows a user to have full access to handle 12 and slot 16 without interference from bag 62.

While the specification has been described in detail with respect to specific embodiments thereof, it will be appreciated that those skilled in the art, upon attaining an understanding of the foregoing, may readily conceive of alterations to, variations of, and equivalents to these embodiments. Also note that the housing and other components may be of any suitable shape depending on the desired application for the device. Accordingly, the scope of the present invention should be assessed as that of the appended claims and any equivalents thereto.

What is claimed is:

1. A device for maintaining the mouth of a bag in an open condition, said device comprising:

a housing having:

a cavity, at least one opening, and at least one support band, wherein a first end of said at least one support band is located in said cavity and at least a portion of said at least one support band extends exterior of said housing and a second end of said at least one support band is also connected to said housing, and said at least one support band has at least two positions relative to said housing, a retracted condition in which a majority of said at least one support band is positioned in said cavity and an extended condition in which less than a majority of said at least one support band is located exterior to said cavity.

2. The device of claim 1, wherein said at least one opening comprises a first opening on a first side of said housing and a second opening on an opposite side of said housing.

3. The device of claim 1, wherein said housing is at least partly comprised of a material selected from the group consisting of plastic, metal, aluminum, steel, ceramic, and rubber.

4. The device of claim 1, further comprising a belt clip attached to said housing.

5. The device of claim 1, wherein said at least one support band has a cross-sectional shape selected from the group consisting of round, elliptical, and rectangular.

6. The device of claim 1, further comprising at least one spool in said internal cavity wherein said at least one support band is attached to said at least one spool.

7. The device of claim 6, wherein said at least one spool comprises a first spool and a second spool.

8. The device of claim 1, wherein said at least one support band is comprised of a material selected from the group consisting of plastic, rubber, metal, aluminum, and ceramics.

9. A device for maintaining the mouth of a bag in an open condition, said device comprising:

a housing, a first support band connected to said housing at a first support band first end, and a second support band connected to said housing at a second support band first end, wherein a length of said first support band external to said housing is variable, a length of said second support band external to said housing is variable, and a first support band second is detachably connectible with a second support band second end.

10. The device of claim 9, further comprising a cavity internal to said housing, a first spool and a second spool, wherein said first support band first end is attached to said first spool and said first spool is rotatably received by said housing in said cavity, said second support band first end is attached to said second spool and said second spool is rotatably received by said housing in said cavity, and rotating said first spool causes said first support band to be wound or unwound on said first spool and rotating said second spool causes said second support band to be wound or unwound on said second spool.

11. The device of claim 10, wherein said first spool and said second spool are biased to expel at least a portion of said first support band and said second support band, respectively.

12. The device of claim 10, wherein said first spool and said second spool are biased to retract at least a portion of said first support band and said second support band, respectively.

13. The device of claim 9, further comprising a first band lock which restricts movement of said first support band and a second band lock which restricts movement of said second support band.

14. A device for maintaining the mouth of a bag in an open condition, said device comprising:

a housing having a cavity internal to said housing, a first spool located in said cavity, a second spool located in said cavity, a first support band attached to said first spool at a first support band first end with a first support band second end located outside said cavity, a second support band attached to said second spool at a second support band first end with a second support band second end located outside said cavity, wherein a length of said first support band exterior to said cavity is variable by rotating said first spool, and a length of said second support band exterior to said cavity is variable by rotating said second spool.

15. The device of claim 14, wherein said first spool and said second spool are biased to retract at least a portion of said first support band and second support band, respectively, into said cavity.

16. The device of claim 14, wherein said first spool and said second spool are biased to extract at least a portion of said first support band and second support band, respectively, out of said cavity.

17. The device of claim 14, further comprising a first band lock which restricts movement of said first support band and a second band lock which restricts movement of said second support band.

18. The device of claim 14, wherein at least one of said first support band and said second support band is comprised of a material selected from the group consisting of plastic, rubber, metal, aluminum, and ceramics.

19. The device of claim 14, wherein said housing is at least partly comprised of a material selected from the group consisting of plastic, metal, aluminum, steel, ceramic, and rubber.

20. The device of claim 14, wherein said at least one support band has a cross-sectional shape selected from the group consisting of round, elliptical, and rectangular.

* * * * *